US010530065B2

(12) United States Patent
Madia

(10) Patent No.: US 10,530,065 B2
(45) Date of Patent: Jan. 7, 2020

(54) WAVEGUIDE RADIATING ELEMENT AND METHOD FOR MAKING THE SAME

(71) Applicant: FINCANTIERI S.P.A., Trieste (IT)

(72) Inventor: Francesco Madia, Trieste (IT)

(73) Assignee: FINCANTIERI S.P.A., Trieste (IT)

( * ) Notice: Subject to any disclaimer, the term of this patent is extended or adjusted under 35 U.S.C. 154(b) by 211 days.

(21) Appl. No.: 15/544,354

(22) PCT Filed: Feb. 9, 2016

(86) PCT No.: PCT/IB2016/050664
§ 371 (c)(1),
(2) Date: Jul. 18, 2017

(87) PCT Pub. No.: WO2016/128886
PCT Pub. Date: Aug. 18, 2016

(65) Prior Publication Data

US 2018/0269590 A1 Sep. 20, 2018

(30) Foreign Application Priority Data

Feb. 11, 2015 (IT) ..... 102015902329544

(51) Int. Cl.
*H01Q 13/06* (2006.01)
*H01Q 21/06* (2006.01)
*H01Q 21/00* (2006.01)

(52) U.S. Cl.
CPC ..... *H01Q 21/064* (2013.01); *H01Q 13/06* (2013.01); *H01Q 21/0087* (2013.01)

(58) Field of Classification Search
CPC .... H01Q 21/064; H01Q 21/205; H01Q 21/08; H01Q 21/0025; H01Q 13/06; H01Q 21/0087; H01P 5/024
See application file for complete search history.

(56) References Cited

U.S. PATENT DOCUMENTS 3,681,714 A * 8/1972 Terakawa ..... H01P 1/067 333/21 R
3,942,138 A * 3/1976 Schaedla ..... H01P 5/08 333/21 R (Continued)

FOREIGN PATENT DOCUMENTS

JP 2006005846 A 1/2006
JP 2012222438 A 11/2012
WO 9620515 A1 7/1996

OTHER PUBLICATIONS

International Search Report for PCT/IB2016/050664 dated Jun. 14, 2016.

*Primary Examiner* — Hai V Tran
*Assistant Examiner* — Bamidele A Jegede

(57) ABSTRACT

A waveguide radiating element (10) is described comprising: —an electrically conductive support body (2, 12) inside which a first recess (3) is defined, delimited at the front by a radiating opening (4), and laterally delimited by at least one side wall (5, 6); —at least one electrically conductive impedance matching unit (20) having a portion (21) projecting from said side wall (5, 6) and positioned inside the first recess (3), the projecting portion (21) having a step or ramp-shaped surface. The impedance matching unit (20) comprises an attachment portion (22) adjacent to the projecting portion (21) and inside the electrically conductive body (2) a second recess (13) is defined, adjacent to the first recess (3) and communicating with the first recess (3), inside which the attachment portion (22) of the impedance matching unit (20) is coupled.

16 Claims, 3 Drawing Sheets

(56) References Cited

U.S. PATENT DOCUMENTS

| | | | | | |
|---|---|---|---|---|---|
| 3,980,974 | A * | 9/1976 | Yamamoto | G01S 7/032 | 333/33 |
| 4,041,420 | A * | 8/1977 | Riblet | H01P 5/024 | 333/35 |
| 5,359,339 | A * | 10/1994 | Agrawal | H01Q 13/0275 | 333/248 |
| 5,404,148 | A * | 4/1995 | Zwarts | H01Q 21/064 | 343/776 |
| 5,418,428 | A * | 5/1995 | Ihm | G01R 1/24 | 315/39.53 |
| 6,115,002 | A * | 9/2000 | Fischer | H01Q 21/064 | 343/770 |
| 6,239,669 | B1 * | 5/2001 | Koriyama | H01L 23/66 | 333/247 |
| 6,407,711 | B1 * | 6/2002 | Bonebright | H01Q 1/286 | 343/705 |
| 7,728,772 | B2 * | 6/2010 | Mortazawi | H01Q 1/3233 | 342/375 |
| 2001/0036465 | A1 * | 11/2001 | Ishll | H01J 37/32192 | 424/400 |
| 2007/0262835 | A1 * | 11/2007 | Vanin | H01P 1/208 | 333/212 |
| 2009/0219107 | A1 * | 9/2009 | Woods | H01P 5/107 | 333/32 |
| 2010/0328188 | A1 * | 12/2010 | Chang | H01Q 21/064 | 343/893 |
| 2011/0148316 | A1 * | 6/2011 | Hafidi | H01J 65/044 | 315/248 |
| 2013/0201073 | A1 * | 8/2013 | Singleton | H01Q 9/0485 | 343/859 |
| 2013/0234904 | A1 * | 9/2013 | Blech | H01Q 13/06 | 343/776 |

* cited by examiner

WAVEGUIDE RADIATING ELEMENT AND METHOD FOR MAKING THE SAME

CROSS-REFERENCE TO RELATED APPLICATION

This application is the 35 U.S.C. § 371 national stage application of PCT Application No. PCT/IB62016/050664, filed Feb. 9, 2016, where the PCT claims priority to and the benefit of, IT Patent Application No. 102015902329544, filed Feb. 11, 2015, both of which are herein incorporated by reference in their entireties.

FIELD OF THE INVENTION

This invention relates to the technical field of telecommunications and in particular concerns a waveguide radiating element and a method for making the same.

STATE OF THE ART

The state of the art knows of array antennas that comprise a plurality of waveguide radiating elements. For example, the aforesaid array antennas are linear arrays, such as, for example, the array described in document U.S. Pat. No. 5,404,148, or are planar arrays, such as, for example, the two-dimensional array described in document U.S. Pat. No. 5,459,474.

It is known that waveguide radiating elements generally comprise a metal structure inside which is defined a cavity that ends with a radiating opening. It is also known that it is necessary to insert in the cavity an impedance matching unit that allows matching the impedance between the propagation of electromagnetic waves in free space and the propagation of electromagnetic waves in the waveguide and vice versa. The aforesaid impedance matching units are typically metal structures having a ramp or step-shaped surface.

Different methods are known for making the waveguide radiating described above. For example, electrical discharge machining methods are known in which processes of chemical attack are employed. Methods of moulding by casting metal are also known. The state of the art also includes numerical control machining methods that, for example, provide for milling operations. All the methods described above generally allow making impedance matching units in one piece with the waveguide.

Methods are also known that provide for making the waveguide and the impedance matching unit as separate pieces and the subsequent fixing of said pieces together, for example by welding or brazing. A radiating element obtained with an example of the above methods is described in document U.S. Pat. No. 5,359,339. Solutions are also known which adopt a fixing of the impedance matching unit to the waveguide by means of a screw, such as for example the solutions described in JP-2012222438 A and U.S. Pat. No. 394,138 A, by inserting the screw in a through opening laying on a plane perpendicular to the radiating opening of the waveguide. However, these solutions do not allow or render complex the production of linear arrays due to the fact that they require to align and to correctly hold in place the impedance matching unit inside the waveguide in order to perform a correct fixing and to guarantee that the impedance matching unit after the fixing is correctly aligned.

It has been observed that the methods of the prior art described above have relatively high costs and/or a high complexity. For this reason, the known methods are generally prohibitively expensive or inconvenient in the case where one must make arrays comprising a high number of radiating elements, for example more than a few ten, especially in the case where the dimensions of the single radiating element are small, for example, of the order of centimeters and/or especially where the radiating elements in the array are separated from each other by small distances.

The purpose of this description is to provide a radiating element that is able to solve or reduce, at least partly, the drawbacks described above with reference to the radiating elements of the known art.

This purpose is achieved through a waveguide radiating element as generally defined in claim 1. Preferred and advantageous embodiments of the aforesaid radiating element are defined in the appended dependent claims.

The invention will be better understood from the following detailed description of a particular embodiment, provided by way of example and, therefore, in no way limiting, in relation to the accompanying drawings, which are briefly described in the next paragraph.

DETAILED DESCRIPTION

Figure 1:
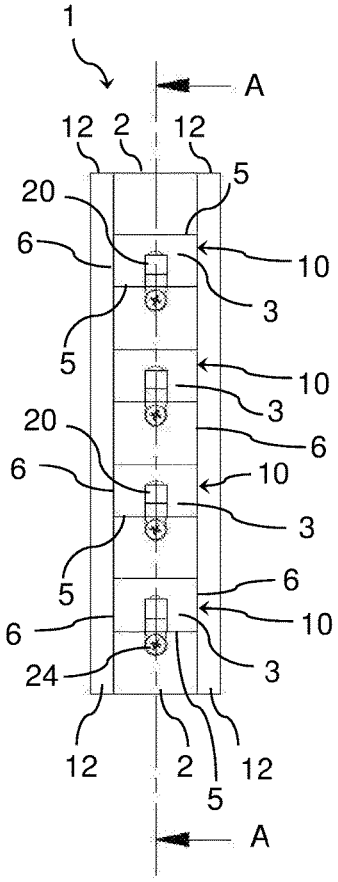
FIG. 1 shows a frontal planar view of an example embodiment of a linear array of waveguide radiating elements, each comprising a respective impedance matching unit.

FIG. 1 shows an example embodiment of an array 1 comprising a plurality of waveguide radiating elements 10 and, in particular, provided by way of non-limiting example with waveguide radiating elements. The array 1 of FIG. 1 is, for example, a transmitting and/or receiving antenna or a portion of a transmitting and/or receiving antenna.

Each waveguide radiating element 10 comprises an electrically conductive support body 2,12 inside which a first recess 3 is defined, delimited at the front by a radiating opening 4, and laterally delimited by at least one side wall 5,6. In the particular example shown, the support body 2,12 is a body common to all the radiating elements. Preferably, the support body 2,12 is made of an electrically conductive metal, for example, aluminium or an aluminium alloy.

According to the embodiment shown in the figures, each first recess 3 is shaped like a rectangular parallelepiped and is delimited above and below by two opposing flat walls 5 and laterally by two opposing flat walls 6. Preferably, each first recess 3 has a bottom wall 7 provided with a through-opening 40 opposed the radiating opening 4.

With reference to FIGS. 1 to 7, each radiating element comprises at least one electrically conductive impedance matching unit 20 having a projecting portion 21 with respect to the side wall 5,6 and arranged inside the first recess 3. The projecting portion 21 has a step or ramp-shaped surface, even although the example in the figures shows only the embodiment wherein said surface is a step-shaped surface.

According to an embodiment, the impedance matching unit is made of the same material as the support body 2,12, i.e., in this case, and without thereby introducing any limitation, aluminium or an aluminium alloy.

The impedance matching unit 20 comprises an attachment portion 22 adjacent to the projecting portion 21. Inside the electrically conductive body 2,12 a second recess 13 is defined, adjacent to the first recess 3 and communicating with the first recess 3, inside which the attachment portion 22 of the impedance matching unit 20 is coupled. So, it is easy to understand that the support body 2,12 and the impedance matching unit 20 are two separate pieces coupled to each other. According to an particularly advantageous embodiment, as shown in FIGS. 2,5,6,7 the projecting portion 21 and the attachment portion 22 of the impedance matching unit are two adjacent portions of a same body made in a single piece.

According to an embodiment, the attachment portion 22 comprises a through-hole 23 and the radiating element comprises a locking element 24 that crosses the through-hole 23.

Figure 6:
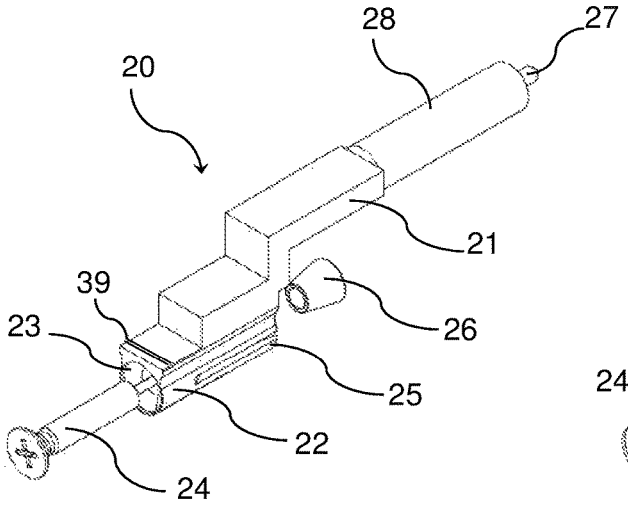
FIG. 6 shows a first perspective view of the impedance matching unit of FIG. 4.
Figure 7:
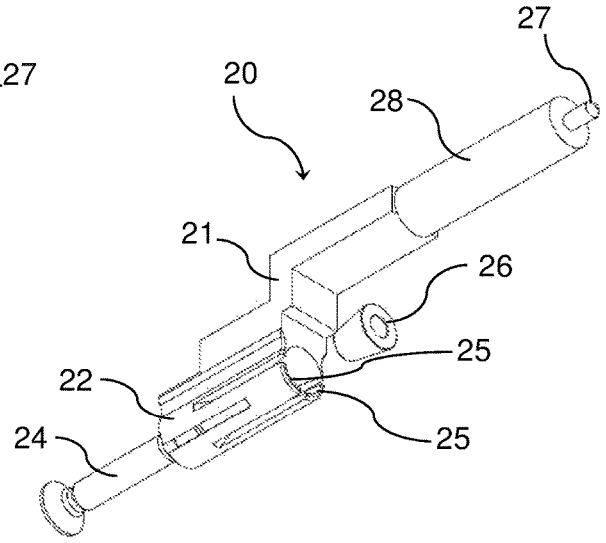
FIG. 7 shows a second perspective view of the impedance matching unit of FIG. 4.

With reference to FIGS. 6 and 7, according to an advantageous embodiment, the attachment portion 22 of the impedance matching unit 20 comprises a part that is deformable under the action of the locking element 24, adapted to lock the attachment portion 22 inside the second recess 13. Preferably, the deformable part comprises at least one spreadable wing 25. In the particular example shown in the figures, the deformable part non-limitingly comprises two wings 25 that can be spread apart by means of a locking element comprising a screw 24 and a slider 26 operatively coupled to the screw 24 and suitable to slide on the screw 24 to be pulled or pushed based on the direction of rotation imparted to the screw, for example using a tool such as a screwdriver. Preferably, the slider 26 has a truncated-conical external shape. The embodiment described above, which provides for at least one spreadable wing 25 in the impedance matching unit 20, in addition to ensuring a stable attachment between the support body 2,12 and the impedance matching unit 20, allows establishing and ensuring over time an excellent electrical connection between the aforesaid parts.

According to an alternative embodiment to that described above, it is possible to provide that the support body 2,12 comprises a third recess 33 having an opening that faces inside the second recess 13. In this case, the locking element 24 is such as to cross the through hole 23 to penetrate within the third recess 33. In this case, the locking element 24 is, for example, a screw and the third recess 33 is, for example, at least partially threaded internally in order to receive an end portion of the screw.

Figure 3:
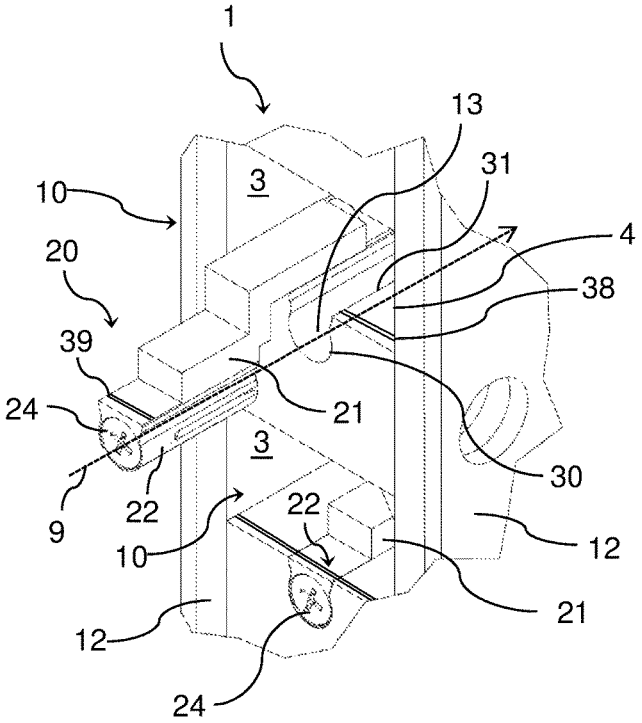
FIG. 3 shows a perspective view of an enlarged part of the array of FIG. 1 in the configuration of FIG. 2.

According to an embodiment, the second recess 13 has a first opening 30 adjacent the radiating opening 4 and a second opening 31 that faces towards the inside of the first recess 3. The attachment portion 22 of the impedance matching unit 20 is coupled inside the second recess 13 for insertion through the first opening 30 of the second recess 13. In FIG. 3, the coupling takes place in practice along the direction of the dashed arrow 9. The above described embodiment is not mandatory, since in a variant embodiment not shown in the figures the first opening of the second recess 13 may be placed of the face 52 (FIG. 3). In this case the insertion direction would be parallel to the plane on which the radiating opening 4 lies.

Figure 2:
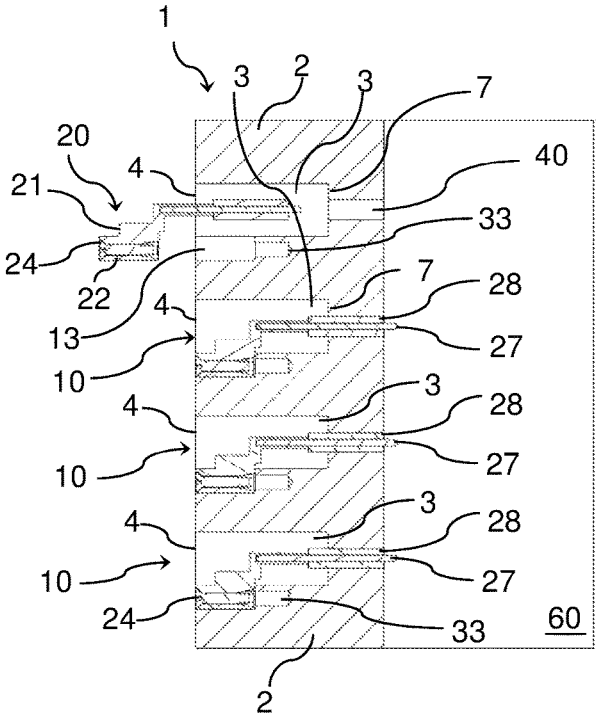
FIG. 2 shows a plan view in lateral section of the array of FIG. 1, in which the section is taken along the section plane A-A indicated in FIG. 1 and in which an impedance matching unit is shown decoupled from the array.

With reference to FIGS. 2, 6 and 7, according to an embodiment, the waveguide radiating element 10 comprises an electrically conductive element 27 adapted to make an electrical connection between the projecting portion 21 of the impedance matching unit 20 and a conductor such as, for example, a central conductor of a coaxial cable or the track of a microstrip printed circuit printed. In the example, the conductive element 27 is a metal pin made integrally or coupled in the projecting portion 21. Said metal pin 27, preferably isolated via a dielectric spacer 28, is such as to cross the bottom opening 40 of the first recess 3 to connect to an electronic signal processing board housed in a compartment 60 of the support body 2,12.

Figure 4:
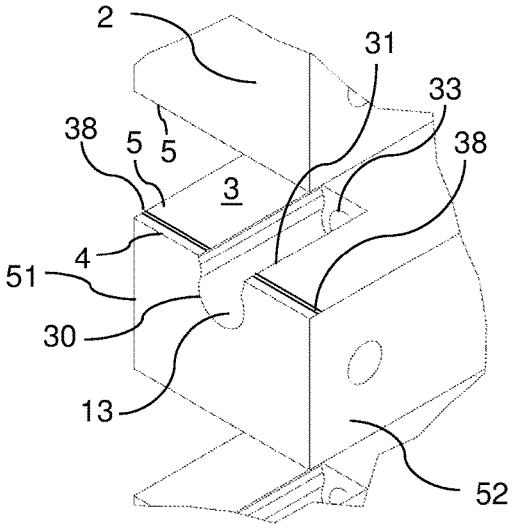
FIG. 4 shows a perspective view of a part of the array of FIG. 3.
Figure 5:
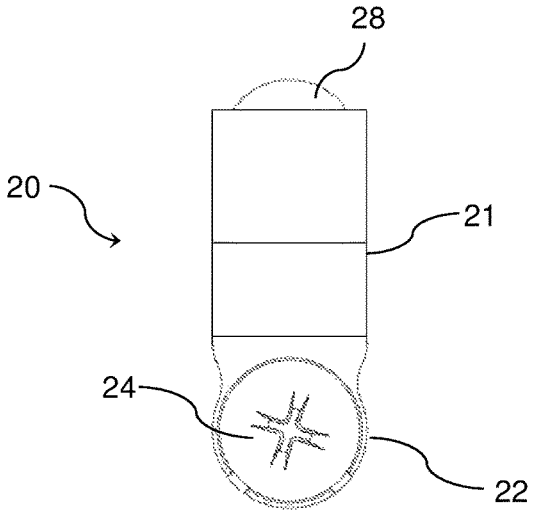
FIG. 5 shows a frontal plan view of an impedance matching unit.

According to an embodiment, the waveguide element is a loaded waveguide element and the aforesaid at least one side wall 5,6 that delimits the first recess 3 comprises two opposed side walls 5 (in the example, the upper horizontal wall and the lower horizontal wall). In this embodiment, the radiating element 10 comprises a cap of dielectric material schematically represented in FIG. 8, occluding the radiating opening 4. Preferably, the aforesaid opposed side walls 5 comprise interlocking attachment elements for interlocking the cap 50 to the support body 2,12. Preferably the interlocking attachment elements comprise for each of the opposed side walls a linear groove 38,39, or a linear prominence, which extends in a direction parallel to the lying plane of the radiating opening 4. In FIGS. 3, 4 and 6, one of the opposed side walls 5, and in particular the lower horizontal wall 5, comprises two linear grooves 38 arranged on opposite sides with respect to the second recess 13 and aligned with each other. By providing a groove 39 also in the attachment portion 22 of the impedance matching unit 20, aligned with the aforesaid opposed grooves 38 when the attachment portion 22 is coupled in the second recess 13, it is possible to form a continuous linear groove 38,39 adapted to receive a linear prominence placed at the base of the cap 50. In this way it is advantageously possible to couple the cap to the support body 2 by sliding it along the prevalent direction of extension of the continuous linear groove 38,39.

According to a preferred but non-limiting embodiment, the cap 50 is made of Teflon. This advantageously allows, in the case of a conical, truncated-conical or circular array, to be able to easily make a dielectric radome slide above the array of radiating elements so that the inner wall of the radome is in contact with the caps 50 of the array.

According to an advantageous embodiment, the second recess 13 has a cross section parallel to a lying plane of the radiating opening 4, which is bulb-shaped. In this embodiment, the attachment portion 22 of the impedance matching unit is counter-shaped with respect to the second recess 13. In this way, it is possible to advantageously couple the attachment portion 22 in the second recess 13, in the coupling configuration ensuring a correct orientation and proper alignment of the impedance matching unit 20 with respect to the support body 2. Alternatively or in addition to the bulb-shaped section, equivalent solutions could provide, in the second recess 3 and/or in the attachment portion 22, one or more guide or centring elements adapted to impose the orientation of the impedance matching unit 20 during the coupling of the attachment portion 22 in the second recess 13.

Figure 8:
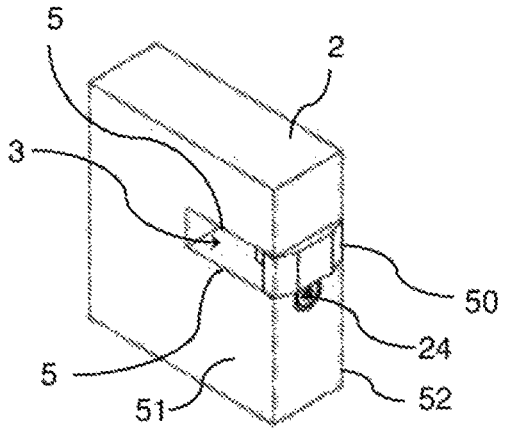
FIG. 8 shows a perspective view of a part of waveguide radiating element provided with a dielectric cap to form a loaded waveguide element.
Figure 9:
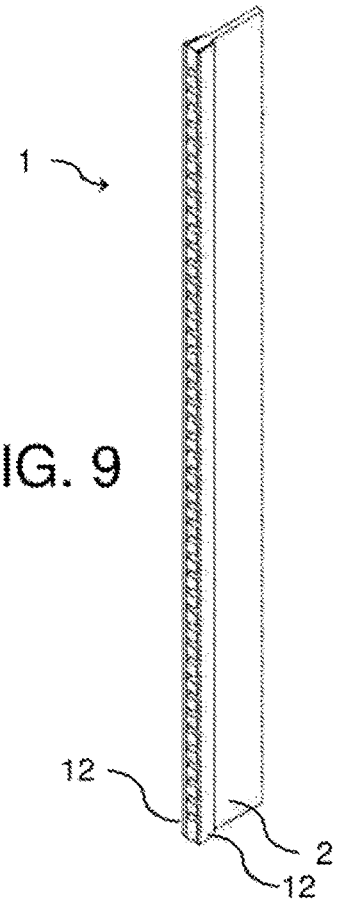
FIG. 9 shows a perspective view of a linear array of waveguide radiating elements.

With reference to FIG. 9, by means of a waveguide radiating element 10 described above, it is possible to make, at a cost and production complexity relatively lower than the known art, a linear array 1 comprising a plurality of radiating elements 10. Moreover, it is possible to provide that the support body 2,12 comprises a first 2 and at least a second body 12 coupled together. With reference to FIGS. 4 and 8, the first body 2 comprises, for each radiating element 10, a pair of recesses comprising the first 3 and the second recess 13. Preferably, the first recess 3 is a cut that passes completely through the first body 2 extending between two opposite faces 51,52 of the first body 2 so that the first recess 3 is open on two opposite sides of the first body 2 along a direction perpendicular to a direction of extension of the linear array. In this embodiment, the second body 12 is coupled to the first body 2 to close said opposite sides for a plurality of first recesses of the respective radiating elements 10, for example for all the radiating elements 10 of the linear array 1. The aforesaid cut is made for example by milling or directly in the casting of the first body 2.

Figure 10:
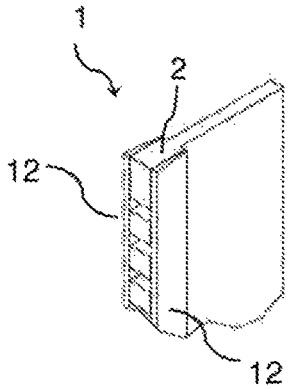
FIG. 10 shows a perspective view of an enlarged part of the linear array of FIG. 9.

With reference to FIGS. 8 to 10, for example the first body 2 has the general shape of a plate with parallel faces and the second body comprises two strips (or generally two closing walls) fixed to two opposite faces of the support body 2 to laterally close the first recesses 3. The two strips 12 may be two separate pieces, or the second body is a frame and the strips 12 represent two opposite sides of the frame and a portion of the first body 2 in which are defined the first recesses 3 is engaged within the aforesaid frame between the strips 12.

Note that, starting from a linear array 1 of radiating elements 10, it is also possible to make two or three-dimensional arrays comprising a plurality of linear arrays 1.

Figure 11:
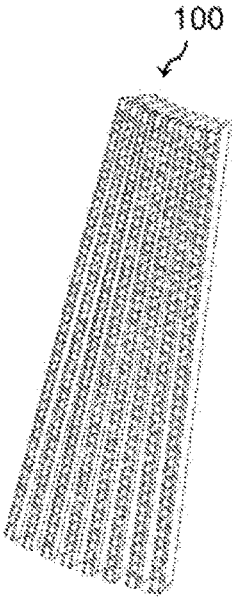
FIG. 11 shows a perspective view of a three-dimensional array of waveguide radiating elements.
Figure 12:
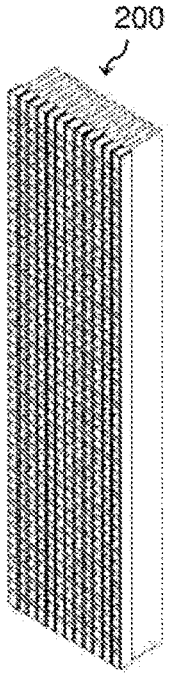
FIG. 12 shows a perspective view of a planar array of waveguide radiating elements.

For example, FIG. 11 shows a three-dimensional array 100, having the shape of a portion of the surface of a truncated cone. With reference to FIG. 10, the aforesaid three-dimensional array 100 can be obtained by placing several linear arrays 1 alongside each other providing, in each of said arrays, strips 12, or in general, side closing walls, that have the two main faces not parallel to each other. With reference to FIG. 12, if instead the strips 12 have their main faces parallel with each other, it is possible to make a planar array 200.

With the aforesaid three-dimensional 100 or planar 200 arrays, one can make antennas, for example, radar system antennas. According to an embodiment, a planar array 200 or a three-dimensional array 100 of the type described above is part of a receiving antenna of a bistatic radar wherein the beam pointing in reception takes place by processing with full-digital beamforming techniques the radiofrequency echo radar signals picked up by the waveguide radiating elements 10 (or better, in this case, receiving elements for the property of reciprocity of the antenna elements) of the array.

Note that the above description for the waveguide radiating element 10 also corresponds to the description of a method for making a waveguide radiating element 10 comprising the steps of:

making an electrically conductive support body 2,12 inside which a first 3 and a second recess 13 are defined, wherein the first recess 3 is delimited at the front by a radiating opening 4, and laterally delimited by at least one side wall 5,6 and wherein the second recess 13 is adjacent and communicating with the first recess 3;

making an electrically conductive impedance matching unit 20 having a first portion 21 and a second attachment portion 22 adjacent to the first portion 21;

coupling the impedance matching unit 20 to the support body 2 by inserting the second attachment portion 22 inside the second recess 13 so that, in a coupling configuration, the first portion 21 is inserted inside the first recess 3 and projects towards the inside of the first recess 3 from said at least one side wall 5,6.

According to a preferred embodiment of the aforesaid method, the coupling step provides for an operation of coupling the impedance matching unit 20 in the second recess 13 by sliding it in a direction preferably perpendicular to a lying plane of the radiating opening 4.

From the above description it is clear that the waveguide radiating element described above allows fully achieving the intended purposes in terms of overcoming the drawbacks of the known art.

Without prejudice to the principle of the invention, the forms of implementation and construction details may be varied widely with respect to what has been described and illustrated purely by way of non-limiting example, without thereby departing from the invention as defined in the appended claims.

The invention claimed is:

1. A waveguide radiating element comprising:

an electrically conductive support body inside which a first recess is defined, delimited at a front by a radiating opening, and laterally delimited by at least one side wall;

at least one electrically conductive impedance matching unit having a portion projecting from said side wall and positioned inside the first recess, the projecting portion having a step or ramp-shaped surface;

wherein:

the impedance matching unit comprises an attachment portion adjacent to the projecting portion, wherein the projecting portion and the attachment portion are two adjacent portions of a same body made in a single piece;

inside the electrically conductive body a second recess is defined, adjacent to the first recess and communicating with the first recess, inside which the attachment portion of the impedance matching unit is coupled.

2. The waveguide radiating element according to claim 1, wherein the attachment portion comprises a through-hole and the radiating element comprises a locking element which crosses the through-hole.

3. The waveguide radiating element according to claim 2, wherein the attachment portion comprises a portion deformable by the locking element for locking the attachment portion inside the second recess.

4. The waveguide radiating element according to claim 3, wherein the deformable portion comprises at least one spreadable wing.

5. The waveguide radiating element according to claim 2, wherein the support body comprises a third recess having an opening facing the inside of the second recess and wherein the locking element crosses the through-hole to penetrate into the third recess.

6. The waveguide radiating element according to claim 1, wherein the second recess has a first opening adjacent to the radiating opening and a second opening facing towards the inside of the first recess and wherein the attachment portion is inserted inside the second recess by insertion through the first opening of the second recess.

7. The waveguide radiating element according to claim 1, wherein the waveguide is a loaded waveguide and wherein said at least one side wall comprises two opposite side walls, wherein the radiating element comprises a cap in dielectric material occluding the radiating opening, and wherein said opposite side walls comprise interlocking attachment elements for interlocking the cap to the support body.

8. The waveguide radiating element according to claim 7, wherein the interlocking attachment elements comprise for each wall a linear groove, or a linear prominence, which extends in a direction parallel to a lying plane of the radiating opening.

9. The waveguide radiating element according to claim 1, wherein the second recess has a bulb-shaped transversal cross-section parallel to a lying plane of the radiating opening and wherein the attachment portion is counter-shaped to the second recess.

10. A linear array of waveguide radiating elements comprising a plurality of radiating elements according to claim 1, wherein the support body comprises a first and at least a second body coupled to each other, wherein the first body comprises for each radiating element a pair of recesses comprising said first and said second recess, wherein first recess is a cut which passes completely through the first body extending between two opposite faces of the first body so that the first recess is open on two opposite sides in a direction perpendicular to a direction of extension of the array and wherein the second body is coupled to the first body to close said opposite sides of a plurality of first recesses of the respective radiating elements.

11. The linear array according to claim 10, wherein the first body is a plate and the second body is a frame and wherein a portion of the plate in which said first recesses are defined is engaged inside said frame.

12. A two or three-dimensional array comprising a plurality of linear arrays according to claim 10.

13. A bistatic radar comprising a two-dimensional or three-dimensional array according to claim 12, wherein the two-dimensional or three-dimensional array is a receiving antenna of said bistatic radar.

14. A method for making a waveguide radiating element comprising the steps of:

making an electrically conductive support body inside which a first and a second recess are defined, wherein the first recess is delimited at a front by a radiating opening, and laterally delimited by at least one side wall and wherein the second recess is adjacent and communicating with the first recess;

making an impedance matching unit having a first electrically conductive portion and an attachment portion adjacent to the first electrically conductive portion, wherein the first electrically conductive portion and the attachment portion are two adjacent portions of a same body made in a single piece;

coupling the impedance matching unit to the electrically conductive support body inserting the attachment portion inside the second recess so that, in a coupled configuration, the first electrically conductive portion is inserted inside the first recess and projects towards an inside of the first recess from said at least one side wall.

15. The method according to claim 14, wherein the coupling step comprises an operation of coupling the impedance matching unit in the second recess by sliding.

16. The method according to claim 15, wherein said sliding is performed in a direction perpendicular to a lying plane of the radiating opening.

* * * * *